United States Patent [19]

Cooley et al.

[11] Patent Number: 4,709,452

[45] Date of Patent: Dec. 1, 1987

[54] METHOD AND MEANS OF COILING START-UP WHICH PREVENTS SLIVER SLINGOVER

[75] Inventors: Edward J. Cooley, Easley; Franklin D. Shaw, Seneca, both of S.C.

[73] Assignee: Platt Saco Lowell Corporation, Easley, S.C.

[21] Appl. No.: 742,165

[22] Filed: Jun. 6, 1985

[51] Int. Cl.[4] ..... B65H 54/80

[52] U.S. Cl. ..... 19/159 R

[58] Field of Search ..... 19/159 R, 159 A

[56] References Cited

U.S. PATENT DOCUMENTS

| | | | |
|---|---|---|---|
| 4,228,563 | 10/1980 | Weber | 19/159 R |
| 4,263,696 | 4/1981 | Mori et al. | 19/159 R |
| 4,400,854 | 8/1983 | Socha | 19/159 R |
| 4,561,151 | 12/1985 | Schöpwinkel | 19/159 R |

*Primary Examiner*—Louis K. Rimrodt
*Assistant Examiner*—J. L. Olds
*Attorney, Agent, or Firm*—Cort Flint

[57] ABSTRACT

The problem of sliver slingover encountered when starting up a coiler of a high speed drawframe or the like at full production rates can be obviated through this invention wherein for an initial interval the rotational axes of the can and its platform and of the fixed coiler tube are brought closer together than one would require to fill the can to maximum capacity from side to side so that the inertial momentum of the spewing sliver is insufficient to over extend the sliver beyond the can's rim; this condition in filling is maintained until a measured amount of sliver sufficient to produce a firm abutting of the topmost coils with the exit of the coiler tube and thus sufficient resistance to the then spewing sliver therefrom to contain the coils within the side to side extent of the can is attained, whereupon through a shifting mechanism, which may be pneumatically operable, the can platform and its axis are shifted a prescribed distance of greater separation away from the fixed coiler tube axis for the remainder of the can filling.

15 Claims, 4 Drawing Figures

Figure 1:
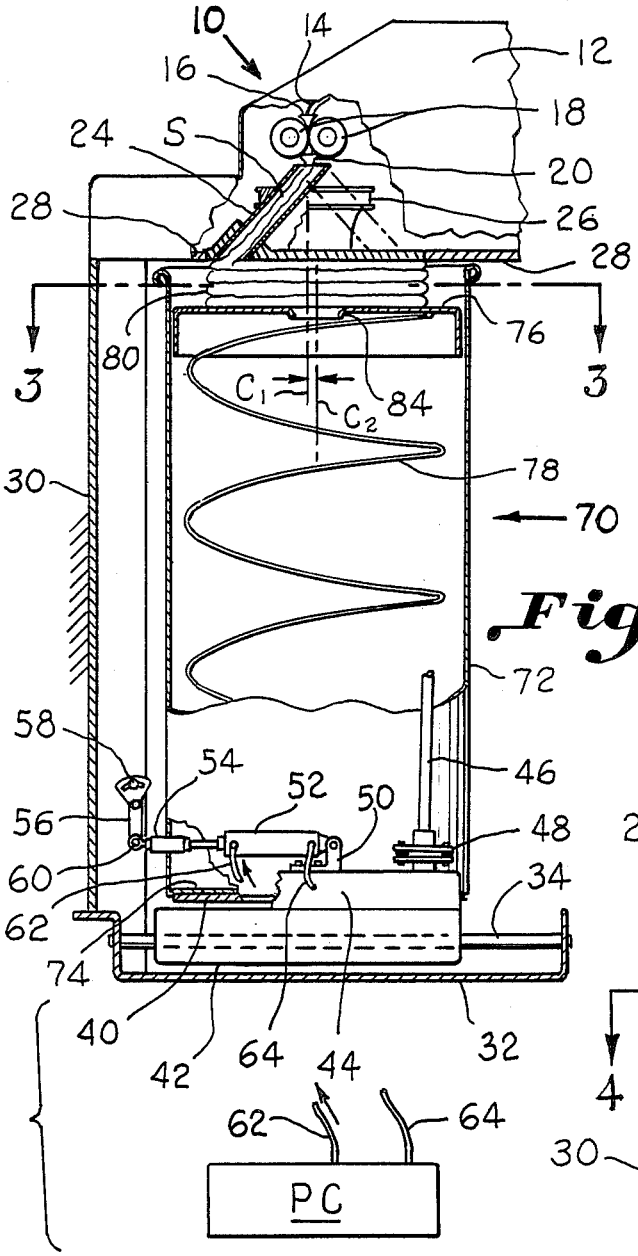

Fig. 3.
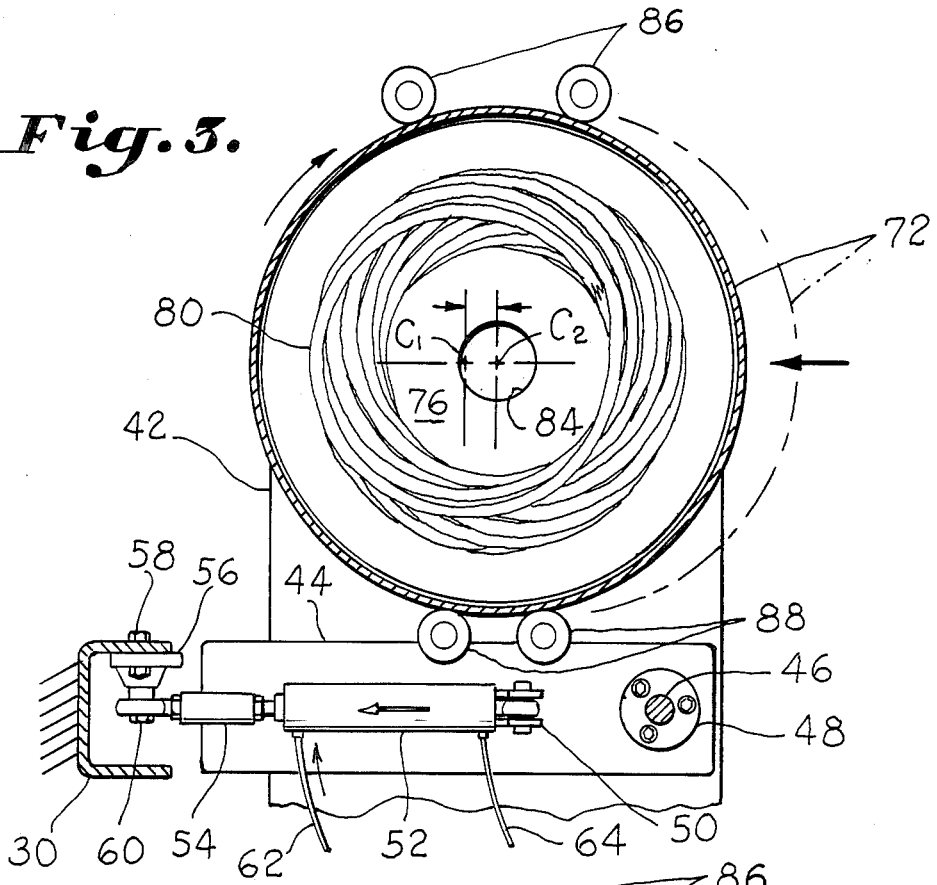
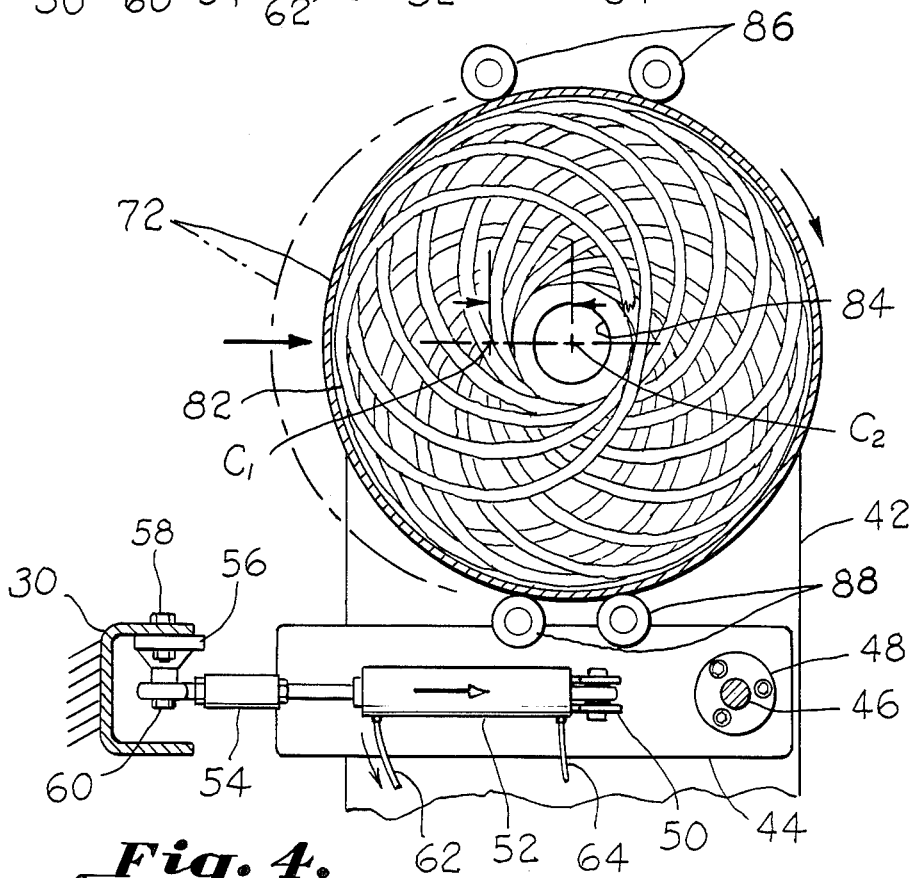
Fig. 4.

METHOD AND MEANS OF COILING START-UP WHICH PREVENTS SLIVER SLINGOVER

BACKGROUND OF THE INVENTION

This invention relates to a simple means and method for preventing or, better, obviating the problem of sliver slingover and its waste on starting up the filling of a sliver can with coiled sliver from a high speed drawframe.

Drawframe sliver is most conveniently collected for conveyance to subsequent yarn forming machines by coiling it as it issues from the drawframe into a cylindrical sliver can. To appreciate the present problems in the art which this invention addresses, one must understand that to increase production in order to reduce unit product costs, the art has mechanized and automated its processes and machines leading to yarn making, including collecting sliver in cans. These advances include vast increases in throughput rates of sliver in drawfames, and thus concomitant increases in coiling rates and the collecting of the sliver. In this, sliver coils delivered to the can must be layered to form a pattern from which subsequently the sliver may be withdrawn without snagging or in any other manner disrupting the orientation of the fibers aligned within the strand. To provide the desired economies, can changing or doffing also has been automated so as to quickly exchange a filled can with one to be filled with sliver coils. It then is desirable to make the exchange very quickly in order to reduce the interval during which the drawframe is stopped during the can changing; this has become yet more and more important with the substantial shortening of the time in which it takes to fill a can, thus in all increasing the number of can changings in any given work interval of time. It is usual to stop the feed of drawframe sliver during can changing. Once the empty replacement can is in position, sliver feed from the coiler can be restarted. Here is where the present problems arise.

From the viewpoint of economics, on paper, it is most desirable in start-up to move from no feed to sliver feed at the highest throughput rate possible in the least time. Prior to the invention, were one to operate the drawframe and coiler at full operating speeds right from start-up, while the mechanisms would show little if any strain one would note almost immediately processing difficulties. These would appear as loops or loopings of sliver encircling the can's rim as the can was rotated, which loops are known in the art as sliver "slingout" or even more commonly as sliver "slingover." Slingover is due to the unrestrained slinging out or spewing forth of sliver upon start-up at high speeds and thus high moments of inertia. While it is possible to minimize slingover by, with great care, selecting sliver cans which have rugged springs thrusting upward the can's piston or false bottom into abutment with the underside of the coiler plate, and thus to provide resistance to the uncontrolled slingout of sliver and contain it within the perimeter of the inner walls of the can, such selection and care are expensive and in the push for economies are often eschewed. Another tactic used to avoid sliver slingover is to significantly reduce the otherwise high moments of inertia of the sliver spewed out on start-up at full production speeds by significantly reducing the speed of sliver or throughput rate.

The significance of the problems of sliver slingover is easily understood when one views what happens upon withdrawal of sliver from the can such as during feed of an open end rotor spinning machine. The coiled sliver is set down in a patterning so that the single sliver strand which makes up the contents of the can may be withdrawn from the can smoothly, and with a minimum disturbance of the ordered array of aligned fibers within the strand; any disturbance of the alignment of the fibers causes irregularities in the strand and ultinately in the yarn product obtained. The loopings of sliver produced by sliver slingover upon start-up are drawn down back into the can along its inner walls as the can fills with its patterned array of coils, to cause a "scuffing" of the coils of sliver that the drawn-back loops may come into contact with, imparting even some intermingling of fibers from the loops and fibers from the coils. Then, upon withdrawing sliver from the can, such as in the feed of an open end machine, a mess can be created causing the sliver to become waste and shutting down the spinning station or delivery. Readily one may appreciate what such circumstances do relative not only waste sliver but also how they adversely affect the rate and costs in yarn production.

The two approaches just mentioned to obviate slingover have not been deemed to be satisfactory in commercial usage. Selection and use of only those cans having proper springs of sufficient strength and force have proven to be unrealistic; also, the reduction of start-up speeds much below ordinary production speeds works in a direction opposite the goal of maximizing production rates.

OBJECTS OF THE INVENTION

Thus it is an object of the invention to provide a method and means for coiling sliver without sliver slingover at full production speed from the very initiation of coiling start-up through completion of can filling and stopping for the doff.

Another object of the invention is to provide the foregoing method and means which are very economical and simple, and easily may be used in an automated way without operator intervention.

These and yet other desirable objects of the invention made evident from the descriptions which follow are attained by the present method and means.

SUMMARY OF THE INVENTION

In the present method and means for filling a cylindrical sliver can with coils thereof at full production rates of from 400 to 700 or more meters of sliver per minute and without sliver slingover, including the steps of and means for receiving the sliver strand, coiling the received strand by passing it through a rotating inclined tube having a fixed axis of rotation $C_1$, and depositing the coils upon the false bottom of a spring biassed can upon a rotating platform therefor, the axis of the platform being $C_2$, the improvements comprise starting filling with the separation of $C_1$ and $C_2$ being in the range of from zero separation to that of about 152 millimeters (6 inches) and continuing filling until a predetermined amount of sliver is deposited such as by timing for from 1 to 30 seconds at that production rate, and then shifting the can platform and rotational axis $C_2$ away from axis $C_1$ with separations from 12 to about 203 mm (0.5 to 8 inches) for the remainder of the filling operation. The shifting may be pneumatically operated.

THE DRAWINGS

Figure 2:
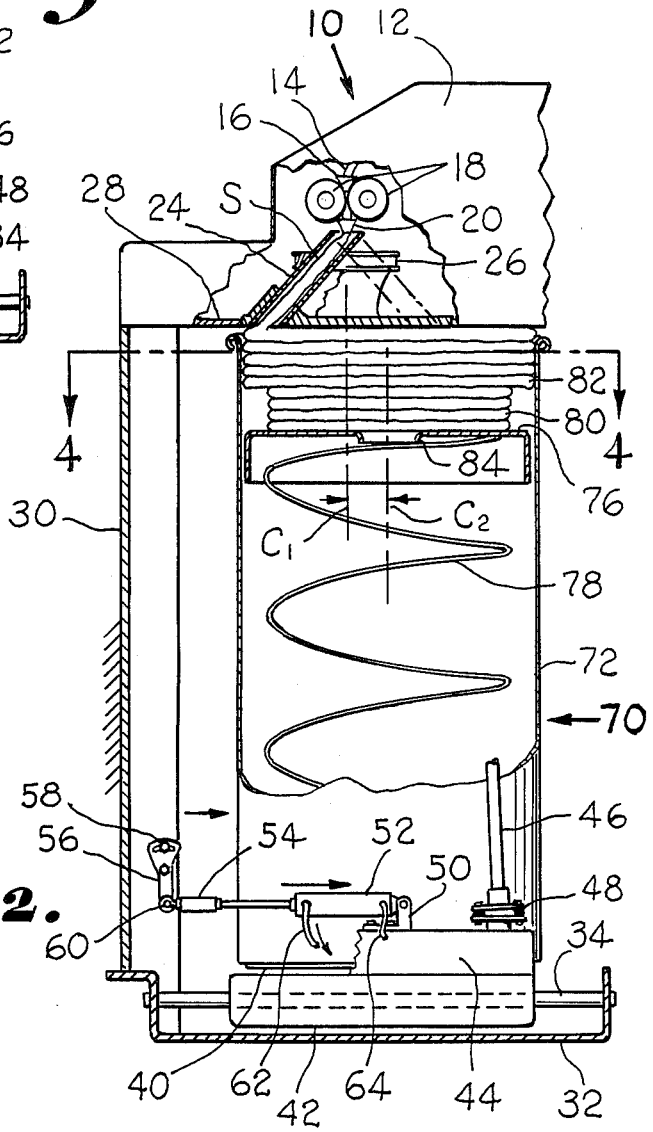

The nature of the invention may be better understood from the explanations which follow when taken in conjunction with the appended drawings in which:

FIG. 1, in front elevational view partially in section, fragmented and broken away for better understanding, shows a sliver coiler and can positioned at start-up with the minimum separation of coiler tube and can rotational axes according to the invention;

FIG. 2, otherwise similar to FIG. 1, shows the coiler and can positioned following start-up and in the production mode with greater separation of the respective axes of rotation;

FIG. 3 is taken in top plan view and partially in section generally along the line marked 3—3 of FIG. 1, and shows the effect on the sliver coils at start-up of the minimum separation of the respective axes of rotation; and FIG. 4, otherwise similar to FIG. 3 but taken along the line marked 4—4 in FIG. 2, shows the effect on the sliver coils and their patterning in the time interval following that of initial start-up, with the greater separation of the respective axes of rotation according to the invention.

A PREFERRED EMBODIMENT

A sliver can filling apparatus, generally designated 10, and commonly known as a "coiler", is shown in FIGS. 1 and 2. Coiler 10 immediately follows the sliver drafting unit of a high speed drawframe (not shown) enshrouded by a cover 12, and receives therefrom a sliver strand S from a condenser guide tube 14. The latter guides strand S to a sliver funnel or trumpet 16, from where it passes through the nip of a pair of driven calender rolls 18 and to and through another trumpet 20. Rolls 18 are driven through interconnections from and by a power source and control device here collectively called instrumentality PC, which is symbolically shown in FIG. 1. Instrumentality PC, for the purposes of this explanation, contains all power and driving elements and controls, including motors, valving, sources of gas pressure and control circuits and devices which which may be needed to power and control the moving elements of the present invention. For present purposes, the exact nature of the power and control elements comprising instrumentality PC as well as their interactions and interconnections do not comprise any innovative portion of the invention; they may be of conventional types interconnected in known manners to achieve the presently described functions.

Trumpet 20 funnels the flow of sliver from driven rolls 18 to and into a coiler tube 24 set at an inclination to the horizontal and fixed for rotation and set so that its exit orifice is in line with the undersurface of a plate 28, Tube 24 is rotated by means of a pulley wheel 26 interconnected with instrumentality PC about a fixed axis $C_1$. A portion of plate 28 is fashioned to rotate with tube 24 and is set into the remainder of plate 28, which latter is fixed to a portion of the chassis of apparatus 10, such as an upright channel support member 30. Chassis of apparatus 10 also includes a base member 32. Fastened intermediate the vertical height of base 32 are a plurality of track members 34 which are shown in the form of cylindrical rods, one of which can be seen in the view shown in the drawings, and upon which a turntable sliver can platform 40 is mounted for rotation by means of interconnection with a turntable base 42 through which latter tracks 34 pass.

Platform 40 acts as a support for a sliver can 70 positioned thereon for rotation about an axis of rotation $C_2$. Also mounted upon base 42 and adjacent to platform 40 is a drive gearbox 44 containing a gearing mechanism to rotate platform 40 and can 70. In turn, gearbox 44 is interconnected through a flexible coupling 48 with a drive shaft 46, the latter obtaining its driving power through interconnections with power, driving and control source instrumentality PC.

Also attached to the aforesaid can turntable assembly is the can axis shifting device of the invention, comprising in this embodiment a fulcrum bracket 50 shown bolted to gearbox 44, an air or pneumatically actuable cylinder 52 pivotally attached to bracket 50, a piston member (not shown) within the body space of cylinder 52 intermediate its two ends fastened to a piston rod which passes out of cylinder 52 from its left end, the rod being unnumbered, an adjustable length coupling 54 which attaches at one end to the left end of the piston rod and at the other end is joined to a pivot link adjustable bracket 56, the latter joined to channel member 30 by a pivot point bolt (unnumbered) shown intermediate the length of bracket 56 and by an end bolt 58 which passes through a slot in the upper end fan portion of bracket 56. Bracket 56 in turn is joined pivotally with coupling 54 by means of a pin or bolt 60. Proximal each end of cylinder 52 and intercommunicating with its right and left interior spaces, these spaces being divided by the movable piston aforementioned, are the ducts 64 and 62 respectively. Ducts 62 and 64 in turn intercommunicate with a source of pneumatic pressure which is a part of instrumentality PC, controlled by timing mechanisms and valving within instrumentality PC to operate in accordance with the invention, as described below.

The above described shifting mechanism shifts the rotational axis $C_2$ of platform 40 and thus of can 70 thereon to and from its two positions, the initial or start-up position wherein the axes $C_1$ and $C_2$ are at minimum separation in accordance with the invention, and the usual running operating or production position wherein axis $C_2$ is shifted a prescribed distance of separation from the rotational axis $C_1$ of coiler tube 24.

Important to a clear understanding of the present process is a knowledge of the construction of can 70; can 70 includes cylindrical vertical walls 72, capped at their bottom by a "true" bottom 74, and containing therewithin a member 76 known as a "false bottom" or piston upon which coils of sliver S are deposited and supported. False bottom 76 is biassed upwardly by a spring 78, which spring 78 as sliver is deposited is depressed increasing its spring force on bottom 76 and on the sliver coils thereon. To permit false bottom 76 to move freely within the walls 72 an egress for air is needed so that as bottom 76 moves downwardly against the bias of spring 78, air is expelled smoothly (and without causing bottom 76 to tilt) through such egress. Such an egress is shown in this embodiment as a central hole defined by rim 84 in false bottom 76; alternately, some cans may have the egress hole in the middle of the true bottom 74.I It has been said that can 70 is mounted atop platform 40; to provide a secure positioning, in this embodiment are seen in FIGS. 3 and 4 spring biassed roller pairs 86 and 88 to compass can 70 within their grip. Rollers 86 and 88 are mounted as part of the can rotating assembly so that when platform 40 and can 70 are laterally shifted according to the invention so too are the rollers 86 and 88.

In operation, empty can 70 is positioned on platform 40 between roller pairs 86 and 88, with all mechanisms stopped, just as happens following a doff of the previously filled can 70.

Power to the drawframe and coiler 10 and turntable 40 is actuated through instrumentality PC. Pressurized air from instrumentality PC through duct 62 pressurizes the left hand interior space portion of cylinder 52 between the left face of the interior piston and the left end of that space portion. Since the position of the piston is fixed relative the chassis and channel 30 because the pivot mid-bolt of bracket 56 and bolt 58 are screwed tight thereto, cylinder 52 riding upon the piston rod is forced to the left to its leftmost position, as shown in FIGS. 1 and 3. In so moving or shifting, cylinder 52 carries with it those elements interconnected thereto through bracket 50, namely all elements which are supported by and ride upon tracks 34, including can platform 40 and can 70. In so doing, the rotational axis of platform 40 and can 70, namely axis $C_2$, is shifted to the left from its former, running position, to its position of minimum separation from the rotational axis $C_1$ of coiler tube 24.

Once this positioning is attained, the drawframe begins to deliver drafted sliver to apparatus 10, with tube 24 rotating about its axis $C_1$ as can 70 rotates about its axis $C_2$. A timing switch in instrumentality PC is activated to maintain the flow of pressurized air through duct 62 for a predetermined interval. Sliver S is coiled and spewed forth from the rotating orifice of coiler tube 24 onto the top of can 70's false bottom 76 for the predetermined interval, forming a patterning of coils 80 as shown in FIGS. 1, 2 and 3, wherein the outer periphery of sliver coilings is measurably less than the inner circumference of walls 72. During this interval, all mechanisms operate at full production speeds, delivering drafted sliver and coiled sliver strand S at full production rates to can 70.

At the end of the predetermined interval, as the timing switch is "timed out", it actuates valving within instrumentality PC to change the flow of pressurized air to a flowpath through duct 64. Pressurized air flows through duct 64 pressurizes the right hand interior space between the right hand face of the interior piston and the right end of cylinder 52. Once again, since the position of the piston is fixed relative the chassis and channel 30, cylinder 52 riding upon the piston rod is forced to the right to its rightmost position, as best seen in FIGS. 2 and 4. In so moving or shifting, cylinder 52 carries with it to the right all elements interconnected therewith as previously described, including rotating platform 40 and rotating can 70, which are supported upon tracks 34. In so doing, the rotational axis $C_2$ of platform 40 and can 70 is shifted to the right to its running position which is the position of maximum separation of axis $C_2$ from axis $C_1$ of coiler tube 24.

To provide one with an appreciation of the distances and positionings and timings of the initial positioning and operating positioning, we have found that one may use a cylinder 52 which has a piston movement therewithin to 50 or so millimeters, which since the piston is fixed as hereinbefore described means that the movement of cylinder 52 upon the piston rod and thus of all elements interconnected thereto, may be in the maximum range of from about 12 to 50 or so millimeters (0.5 to 2 inches). Thus, one may move axis $C_2$ between its closest to its furtherest positioning from axis $C_1$ by such distances, in ordinary mill practice of the invention. The exact distance by which axis $C_2$ should be shifted for any particular embodiment is largely dependent upon such factors as the weight of the sliver S being processed, the speed of delivery of sliver S at usual processing rates for the particular application, which factors determine the inertial momentum to be considered, the can diameter used, as well as other processing factors well known to the art. For many weight slivers S, we have found that a maximum shift of about 25 millimeters usually is quite effective in present practice. Further, we have found that if one were to use an initial interval in the formation of patterned coils 80 of about or so seconds at ordinary production rates of 500 to say 600 meters of sliver S per minute, that usually the depression or compression of spring 78 would be sufficient to impose an abutting force between the underside of plate 28 and the top of patterned coils 80 that one may shift the rotational axis $C_2$ to its maximum separation from axis $C_1$ to provide wall 72 to wall 72 filling of can 70 without sliver slingover, thence producing a patterning 82 of coils of sliver S, as best seen in FIG. 2 and as also seen in FIG. 4.

Depending upon the diameter of the can used, it has been found that one may use an initial spacing of platform axis $C_2$ from coiler tube axis $C_1$ which may be in the range of zero separation, meaning that the axes $C_2$ and $C_1$ would be not merely parallel but actually coincident, up to about 152 millimeters or 6.0 inch spacing therebetween; and, that the distance of separation of these axes at the second or running or operating position may be in the range of 12 or so millimeters (0.5 inch) to that of 203 or so millimeters (8.0 inches). Also, depending upon other factors relating to the spring strength and extention as well as the nature of the sliver and its surface frictional characteristics, at ordinary production rates of from 400 to say 700 or perhaps even more meters of sliver per minute one finds that the amount of sliver deposited within the range of 1 to 30 seconds of delivery may be sufficient to meet the criterion above stated that sufficient abutting force between the topmost coils and the exit of the tube 24 to act as an adequate restraining force on sliver S then being spewed out to permit the shift of axis $C_2$ to its second position of greater separation from $C_1$ to fill can 70 from wall 72 to wall 72 thereabout with sliver coils without sliver slingover.

Although we have shown that the present shifting means, mechanical in nature, is shifted through the use of pneumatic force, other types of force or power may be used, both mechanical and or electrical in nature to provide the herein required axial positionings of the present process. Yet other variations from what has been described and or shown here immediately may come to mind by one skilled in the art, and be obvious in view of the teachings herein.

That which is claimed is:

1. In an apparatus for filling a cylindrical can with coils of sliver, including means for receiving strand sliver, means for coiling said strand silver to form a coiled silver by passing it through a rotating inclined tube having a fixed tube axis of rotation, means for depositing said coiled sliver in coils atop a spring biassed false bottom of a cylindrical sliver can, and means for rotating said can upon a platform therefor about a platform axis of rotation for said platform, the improvement comprising:

means for shifting the position of said platform and said platform axis of rotation between an initial position wherein said platform axis is aligned parallel to said fixed tube axis at a prescribed and predetermined distance of separation therebetween, and a second position wherein said platform axis is aligned parallel to said fixed tube axis at a second predetermined and prescribed distance of separation therebetween, and wherein said second distance of separation is greater than said first distance of separation by a prescribed amount; and control means for controlling said means for shifting, including measuring means for measuring the delivery of strand sliver deposited as coils, powering means for powering said shifting means, and actuating means for actuating and deactuating said measuring means and for actuating and deactuating said powering means;

whereby, upon said measuring means being actuated, or deactuated, said means for shifting is powered by said powering means and shifts said platform from said second position to said first position, and then upon said actuating means actuating said measuring means and said measuring means measuring out a predetermined amount of sliver for delivery to said can, said means for shifting again is powered by said power means to shift said platform from said initial position to said second position.

2. The improvement as in claim 1, wherein said means for shifting is mechanical in nature.

3. The improvement as in claim 2, wherein said means for shifting is powered pneumatically.

4. The improvement as in claim 1, wherein said prescribed amount is in the range of from 12 millimeters (0.5 inch) to 51 millimeters (2.0 inches).

5.The improvement as in claim 1, wherein said distance of separation at said initial position is in the range of zero separation, wherein said axes of rotation of said tube and said platform are coincident, to that of 152 millimeters (6 inches).

6. The improvement as in claim 1, wherein said distance of separation at said second position is in the range of 12 millimeters (0.5 inch) to that of 203 millimeters (8 inches).

7. The apparatus as in claim 1, wherein said measuring means is a timing means.

8. The improvement as in claim 1, wherein said predetermined amount of sliver is an amount of sliver sufficient to cause the then delivered coils of sliver to firmly abut the exit of said inclined rotating tube.

9. In a method for filling a cylindrical can with coils of sliver, including the steps of receiving strand sliver, coiling said strand sliver to form coiled sliver by passing it through a rotating inclined tube having a fixed axis of rotation, depositing said coiled sliver in coils atop a spring biassed false bottom of a cylindrical sliver can, and rotating said can upon a platform therefor about a platform axis of rotation for said platform, the improvement comprising:

(a) starting the filing process with said platform set at or shifted to an initial position, wherein said platform axis is aligned parallel to said fixed rotational axis of said tube at a prescribed and predetermined distance of separation therebetween, and actuating a sliver measuring device, the receiving of strand sliver, its coiling and depositing atop said can's false bottom;

(b) meausring out a predetermined quantity of coiled sliver deposited sufficient to cause the delivered coils of sliver firmly to abut the exit of said rotating inclined tube; and (c) thereupon shifting said platform and its axis of rotation to a second position, wherein said platform axis is aligned parallel to said fixed rotational axis of said tube at a second prescribed and predetermined distance of separation therebetween, and wherein said second distance of separation is greater than said first distance of separation by a prescribed amount.

10. An improved process as in claim 9, wherein said shifting is pneumatically operated.

11. An improved process as in claim 9, wherein said prescribed amount is in the range of from 12 millimeters (0.5 inch) to 51 millimeters (2.0 inches).

12. An improved process as in claim 9, wherein said distance of separation at said initial position is in the range of zero separation, wherein said axes of rotation of said tube and said platform are coincident, to that of 152 millimeters (6 inches).

13. An improved process as in claim 9, wherein said distance of separation at said second position is in the range of 12 millimeters (0.5 inch) to that of 203 millimeters (8 inches).

14. An improved process as in claim 9, wherein said measuring is by timing.

15. An improved process as in claim 14, wherein said timing is in the range of from one to thirty (1-30-)seconds, and the rate of depositing of said coils is from 400 to 700 meters of sliver per minute.

* * * * *